United States Patent [19]

Lockwood

[11] Patent Number: 4,672,780

[45] Date of Patent: Jun. 16, 1987

[54] BUILDING PANELS

[76] Inventor: David N. Lockwood, 6191 Ewart Street, Burnaby, B.C., Canada, V5J 2X4

[21] Appl. No.: 647,017

[22] Filed: Sep. 4, 1984

[51] Int. Cl.[4] ..... E04C 2/32; E04C 2/38

[52] U.S. Cl. ..... 52/82; 52/630; 52/741; 52/792; 52/DIG. 10

[58] Field of Search ..... 52/82, 630, 792, DIG. 10, 52/81, 71, 741

[56] References Cited

U.S. PATENT DOCUMENTS

| | | | |
|---|---|---|---|
| 3,389,513 | 6/1968 | Ruggles | 52/82 |
| 3,439,456 | 4/1969 | Bailey | 51/125 |
| 3,524,288 | 8/1970 | Coppa | 52/71 X |
| 3,668,796 | 6/1972 | Patterson | 52/DIG. 10 X |
| 3,749,636 | 7/1973 | Tranquillitsky | 52/DIG. 10 X |
| 3,871,143 | 3/1975 | Quick | 52/82 X |
| 3,914,486 | 10/1975 | Borgford | 52/792 X |
| 4,145,850 | 3/1979 | Runyon | 52/71 |
| 4,227,334 | 10/1980 | Hooker | 52/DIG. 10 X |

FOREIGN PATENT DOCUMENTS

| | | | |
|---|---|---|---|
| 35148 | 9/1981 | European Pat. Off. | 52/630 |
| 1436710 | 3/1966 | France | 52/792 |
| 592390 | 5/1959 | Italy | 52/630 |

*Primary Examiner*—Stuart S. Levy
*Assistant Examiner*—Lynn M. Sohacki
*Attorney, Agent, or Firm*—Fetherstonhaugh & Co.

[57] ABSTRACT

Integral, elongated panels have sets of flanges arranged on lines which define folded, transversely triangular elements. These elements extend laterally across the panel, and are dimensioned such that a pair of adjacent parallel side edges of two corresponding panels can mate. The flanges preferably extend along the entire length of the lines defining the folded transversely triangular elements, and may usefully be linear and arranged on lines defining congruent elements with triangular faces, and sloping side edge portions of the panel. By such arrangement, a panel is obtained which in conjunction with other such panels, can produce a curved surface, which curvature may be reversed in direction in any point along a structure surface, by inverting the next adjacent series of panels.

6 Claims, 20 Drawing Figures

BUILDING PANELS

FIELD OF THE INVENTION

This invention relates to building panels useful in constructing a variety of structures.

DESCRIPTION OF PRIOR ART

In attempts to minimize building contruction time, and construction costs, numerous types of building panels have been devised which are prefabricated and can be connected together to produce surfaces in a building or structure. In designing such panels, it is desireable to produce a panel which can produce structurally strong walls or the like, and which also retains a fair degree of flexibility, such that structures of varying shapes can be constructed utilizing panels of the same basic shape.

Examples of panels which have attempted to meet the above requirements, are disclosed in U.S. Pat. Nos. 3,389,513 to Ruggles and 3,439,456 to Silberkuhl. The panel disclosed in the Ruggles patent consists of two opposed, folded trianglular sections disposed about the middle of the panel, and extending lengthwise thereon. The portions of the panel between the folded sections and side edges of the panel are flat, and are provided at their edges with flanges by which the side edges of adjacent panels can be connected together. This requires that such panel described be formed individually. When it is then desired to construct a structure surface using such panels, the panels must be individually connected together. In addition, panels with adjacent connected side edges cannot be inverted with respect to one another, so as to produce a structural surface which has a varying direction of curvature as desired. Each of the panels of the Silberkuhl patent, on the other hand, consists of a generally rectangular panel with a lengthwise extending folded triangular section thereon. The remainder of the panel is flat and extends to flanges thereof. It is possible to arrange adjacent sets of such panels to be disposed at an angle to one another, as described in the patent. However, again, as in the panel in the Ruggles patent, each of the panels must be individually connected together through their flanges. In addition, due to the shaping of each individual panel and the presence of its particular flanges, it is again not readily possible to reverse the direction of curvature of a structure surface by simply inverting some of the connected panels.

U.S. Pat. No. 3,914,486 to Borgford further discloses a three dimensional panel structure apparently formed from a unitary sheet. However, such a panel apparently does not allow reversing curvature to be obtained in a structure surface using such panels by simply inverting such panels. Further particular panels are disclosed in U.S. Pat. Nos. 4,145,850 to Runyon, 3,668,796 to Patterson, and 4,227,334 to Hooker.

SUMMARY OF THE INVENTION

The present invention provides an integral, elongated panel. Such panel comprises sets of flanges arranged on lines which define folded, transversely triangular elements extending laterally across the panel section, such that a pair of adjacent parallel side edges of two corresponding panels, can mate. In one arrangement, the elements extend laterally across the panel in alternating direction.

Preferably, each flange is linear and arranged on lines defining congruent elements with triangular faces. In such case, the transversely triangular elements contain sloping side edge portions of the panel, such that a pair of adjacent parallel side edges of two such panels, can mate when the panels are laterally inclined toward one another. In addition, each panel may usefully be provided with one interior flange only. Alternatively, each panel may have a plurality of interior flanges. The sets of flanges may extend only part way along the length of the lines defining the folded transversely triangular elements, so that a panel contains only truncated elements or extend along the entire length thereof so that a panel contains a plurality of such entire elements.

The panel may be constructed with first and second side edges thereof, generally curved, with the first side edge having a greater radius of curvature than the second side edge. In such case the transversely triangular elements are all radially aligned (that is, directed or pointed toward a common center of a circle on which the panel lies), and directed toward the second side edge. In addition, first side edge portions of a first set of alternate elements are lower than respective opposite side edge portions. Second side edge portions of elements of a second set of alternate elements interposed with those of the first set, are also lower than respective opposite first side edge portions thereof, with the second side edge portions of the elements of the second set being lower (i.e. of less height taking the flanges defining the elements as a base) than the first side edge portions of the elements of the first set. By such arrangement the first side edge of a first such panel can mate with an adjacent congruent second side edge of a second such panel, when the second panel is inclined downwardly with respect to the first panel (the "downward" direction being toward the flanges on lines defining the elements).

A method of forming panels as described is further provided, which method comprises folding a flat sheet having parallel side edges to produce the flanges. In the case of the panel described with generally curved side edges, the method further includes forming equiangular triangular darts on alternate side edges of the sheet.

An elongated panel is further provided, which comprises a first set of coplanar, parallel flanges extending laterally across the panel at an angle to the side edges of it. A second set of coplanar flanges are provided which extend parallel with the flanges of the first set and laterally across the panel in alternating relationship with the flanges of the first set. The second set is also disposed in a plane parallel to that in which the first set of flanges lies. An elongated panel structure can be created from such panels, utilizing at least two panels of the foregoing construction. The panels are disposed parallel to one another with adjacent connected faces, and orientated such that the flanges of one panel, extend across the panel structure in a direction opposite to that of the flanges of the other panel. Preferably, the flanges of each panel in the panel structure, extend at an angle of 45 degrees between the side edges thereof.

Further panel structures may be created utilizing other panels as previously described, and a reinforcing, elongated panel disposed with a face thereof connected to a face of the first panel. Methods of contructing a structure surface from a plurality of panels as described, are also provided. The methods include forming such panels by folding sheet metal coil stock, as well as providing darts where necessary. In use, the panels are positioned with mating side edges parallel and adjacent to one another, such mating side edges then being connected by means of welding, screws, or other suitable fastening means. If desired, at the same time, or shortly before or thereafter, a plurality of reinforcing panels as described, can also be formed from sheet metal coil stock, which then have their faces joined to respective faces of the first panels. In one particular method, the panels are formed from sheet metal coil stock and connected together, as the structure surface is raised.

DRAWINGS

Embodiments of the invention will now be described with reference to the drawings, in which.

Figure 2:
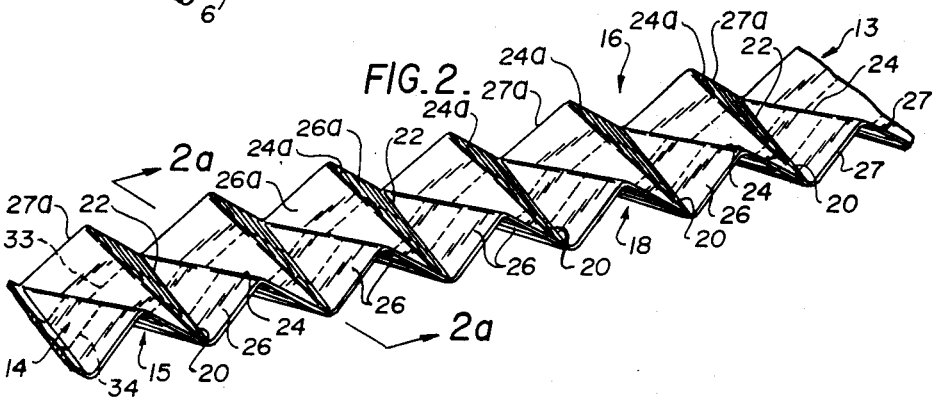
FIG. 2 is a perspective view of a panel of the present invention.
Figure 3:
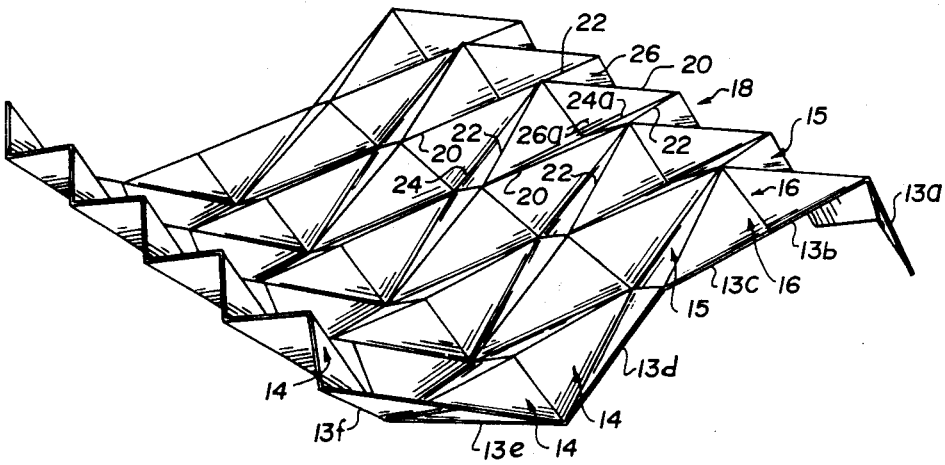
Figure 2A:
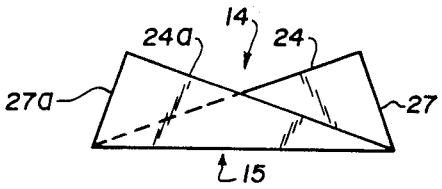
Figure 3A:
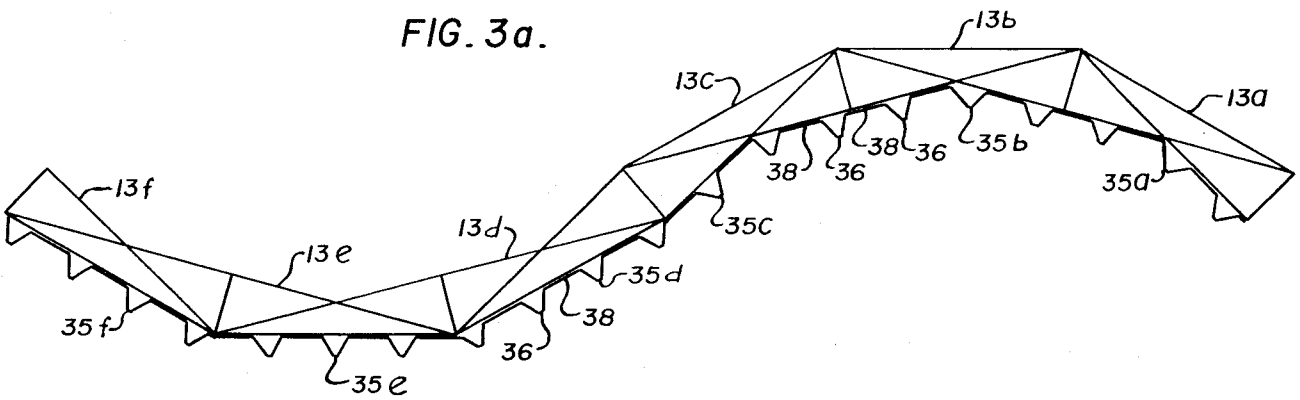
Figure 4:
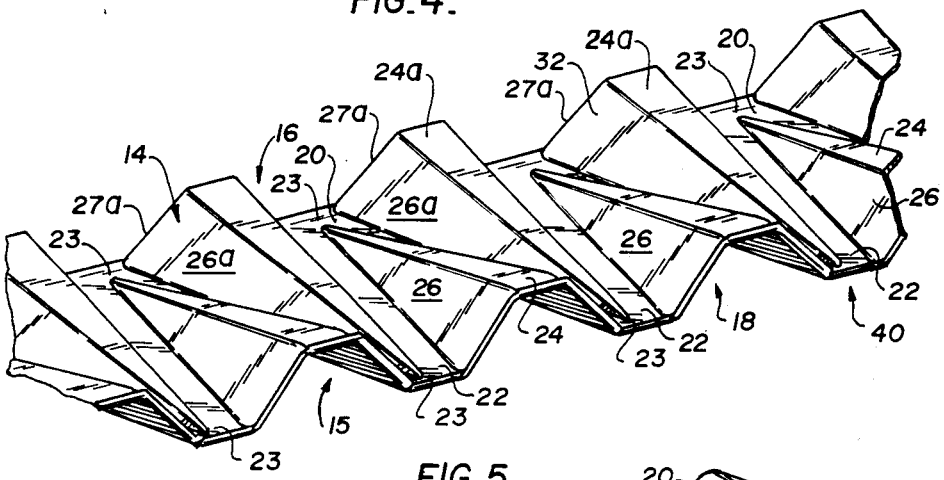
Figure 5:
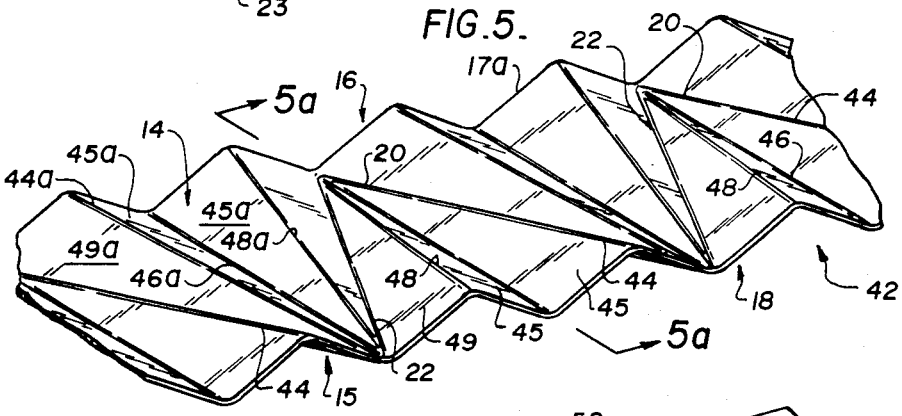
Figure 6:
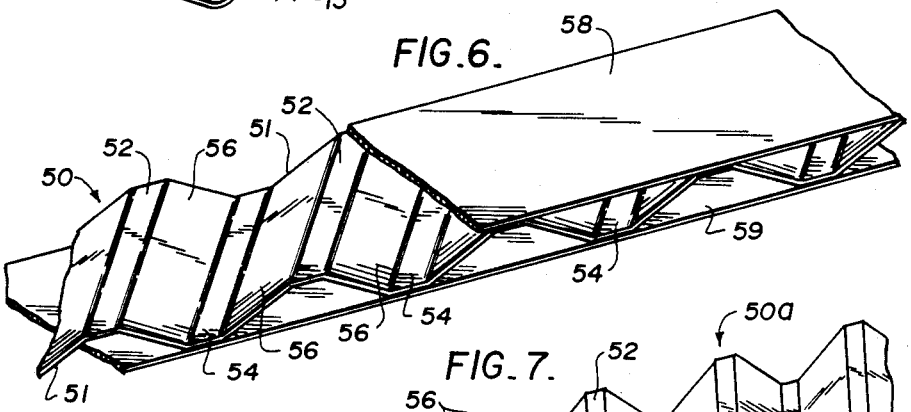
Figure 7:
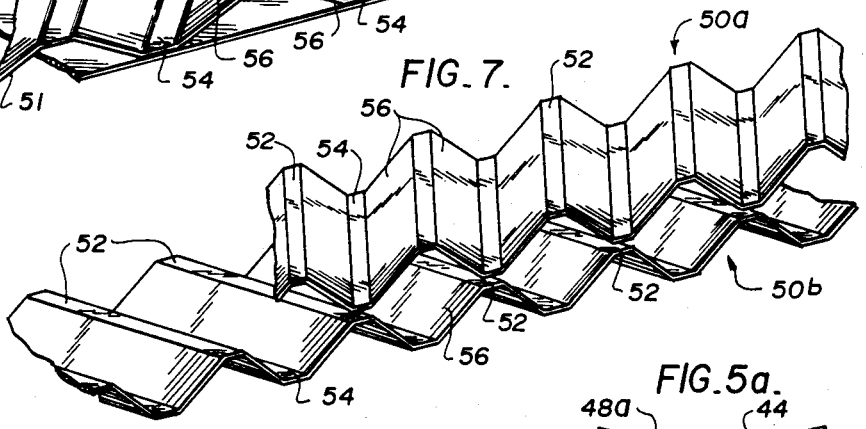
Figure 5A:
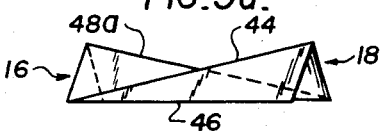
Figure 8:
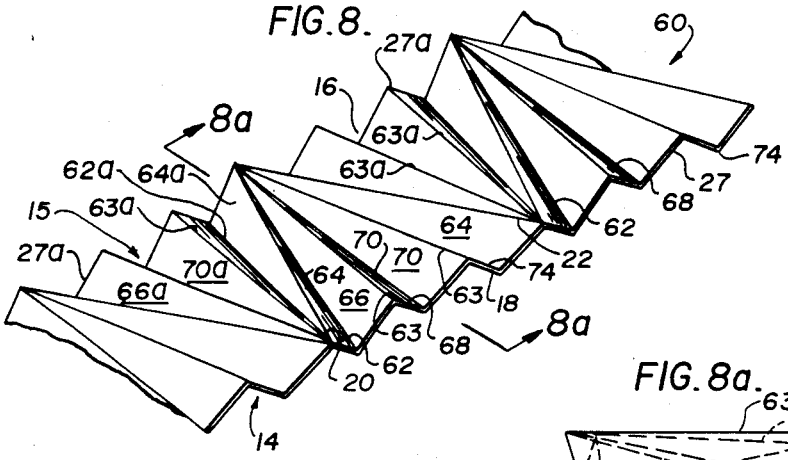
Figure 8A:
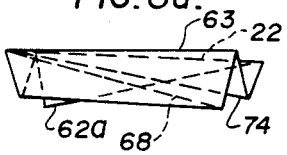
Figure 8B:
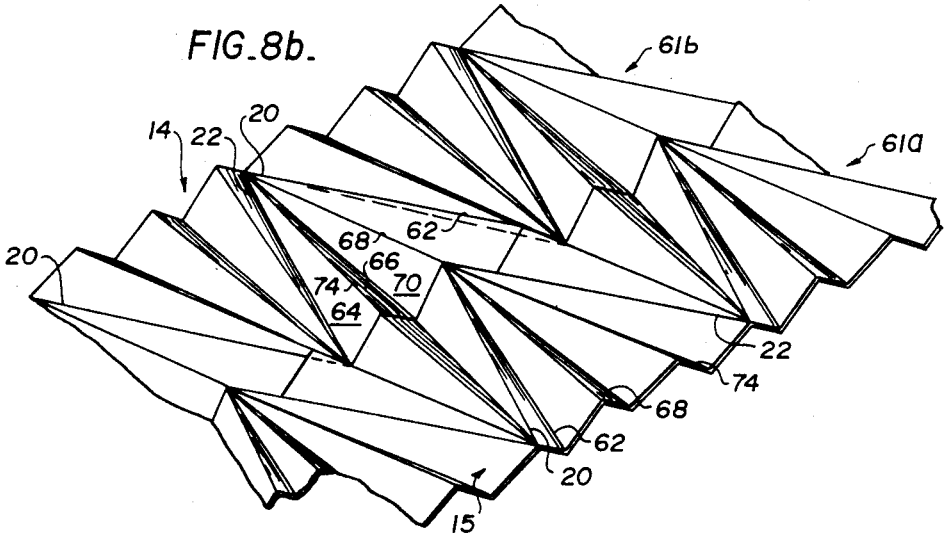
Figure 5B:
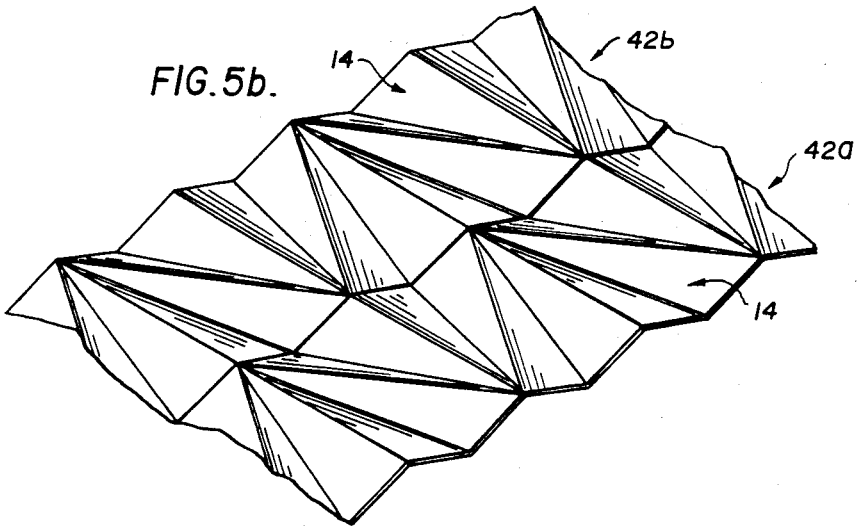
Figure 9:
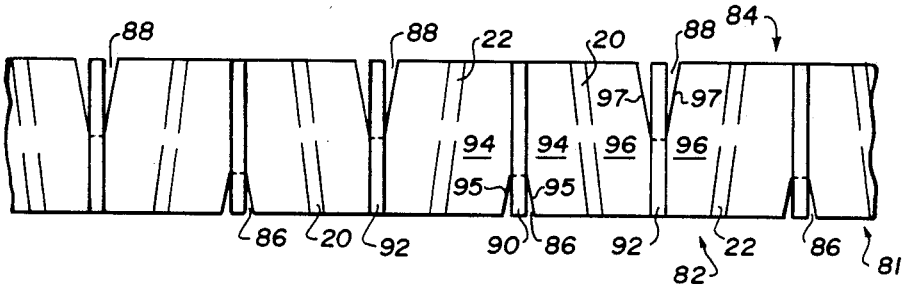
Figure 9A:
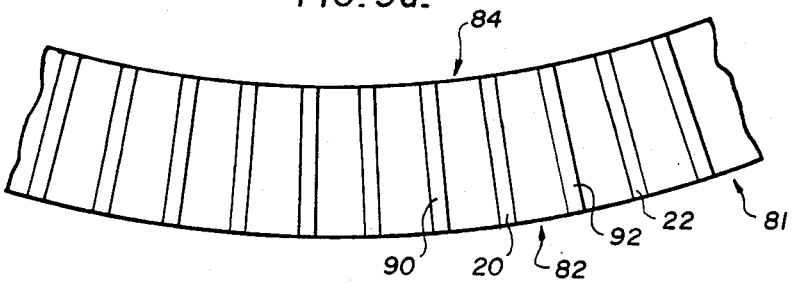
Figure 9B:
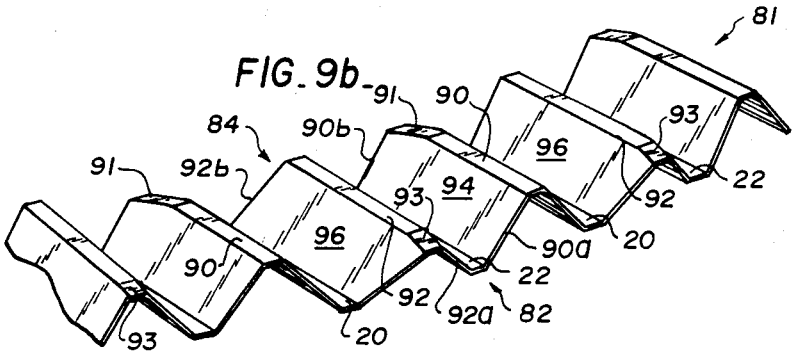

FIG. 2*a* is a cross-sectional view along the line 2*a*—2*a* of FIG. 2;

FIG. 3 is a perspective view of a structurel surface being constructed with a plurality of panels of the type shown in FIG. 2;

FIG. 3*a* is a cross-section of a portion of a structural surface constructed with a plurality of panels of the type shown in FIG. 2, in conjunction with a plurality of further panels;

FIG. 4 is a perspective view of an alternate form of the panel of the present invention;

FIG. 5 is a perspective view of a further panel of the present invention;

FIG. 5*a* is a cross-sectional view along the line 5*a*—5*a* in FIG. 5;

FIG. 5*b* is a perspective view of a portion of a panel structure utilizing a plurality of panels of the type in FIG. 5;

FIG. 6 is a perspective, partially broken away view of a panel structure utilizing another form of the panel of the present invention;

FIG. 7 is a perspective view of another panel structure utilizing the panel shown in FIG. 6;

FIG. 8 is a perspective view of a further panel of the present invention;

FIG. 8*a* is a cross-sectional view along the line 8*a*—8*a* of FIG. 8;

FIG. 8*b* is a perspective view of a portion of a structure surface utilizing a plurality of the panels of FIG. 8;

FIG. 9 is a plan view of a flat blank cut in a shape to produce the panel of FIGS. 9*a* and 9*b*;

FIG. 9*a* is a plan view of another panel of the present invention, folded from the blank of FIG. 9;

FIG. 9*b* is a perspective view of the panel of FIG. 9*a;*

Figure 10:
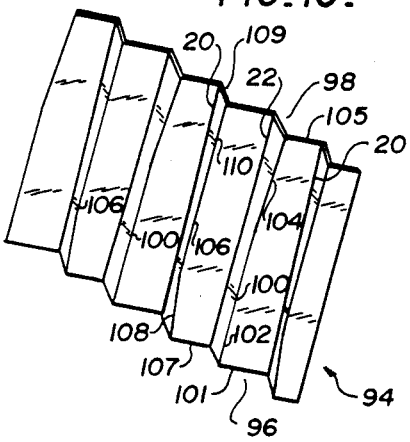
Figure 11:
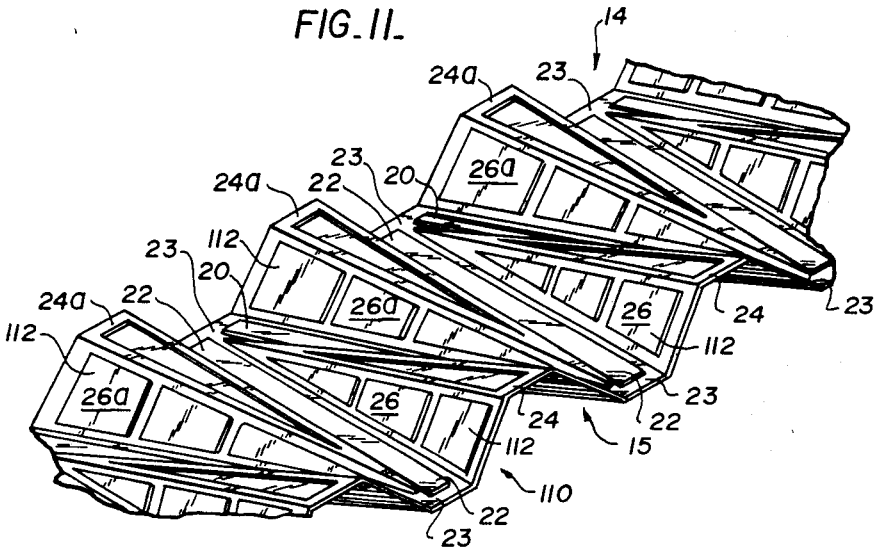
Figure 10A:
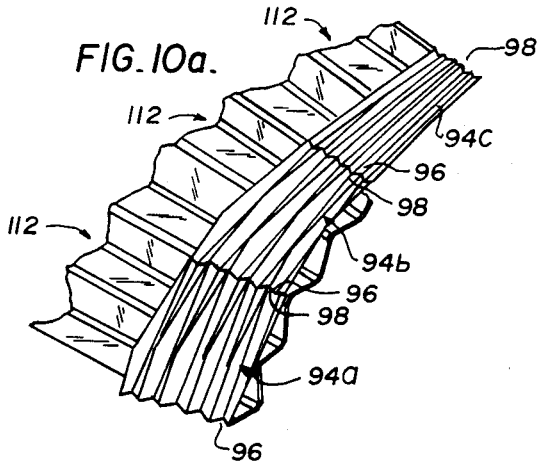

FIG. 10 is a perspective view of an another panel of the present invention;

FIG. 10*a* is a perspective view of a structure surface constructed utilizing a plurality of panels of the type of FIG. 10, with portions thereof removed to show reinforcing panels;

FIG. 11 is a perspective view of a portion of a further panel of the present invention;

DETAILED DESCRIPTION OF EMBODIMENTS OF THE INVENTION

Referring first to FIG. 2, an elongated panel 13 is shown, the panel having an upper face 14, and a lower face 15. In this regard, it should be noted that terms such as "lower", "upper", and the like, are used throughout this application in a relative sense only, as will become apparent. The panel 13 is formed by folding an elongated flat sheet, with parallel side edges. Panel 13 which results, has a set of parallel, coplanar flanges 20 as well as a set of parallel, flanges 22, coplanar with flanges 20. The foregoing flanges extend laterally across the panel in alternating direction as shown, and define between each adjacent pair of flanges 20, 22, a folded transversely triangular element which extends laterally across the panel in a direction opposite that of the adjacent folded transversely triangular elements. By "transversely triangular" in reference to the folded elements, is meant that they are triangular in shape as viewed from above. One such set of triangular elements consists of parallel, coplanar flanges 24 extending substantially perpendicularly across panel 13, and increasing in height from first side edge 16 to second side edge 18. The foregoing elements are pointed, or directed toward first side edge 16. Triangular faces 26 extend between each flange 24 and adjacent flanges 20, 22. As the panel has been folded from a sheet material, such as sheet metal, with parallel side edges each triangular section formed by flanges 24 and adjacent faces 26, will have insloping side edge portions 27, as most clearly shown in FIG. 2*a*.

The other set of triangular sections of panel 13, are defined by flanges 24*a*, and adjacent triangular faces 26*a*. Such triangular sections likewise have insloping side edge portions 27*a*, again as most clearly shown in FIG. 2*a*. All of the triangular sections are congruent, and have side edge portions 27 intersecting flanges 24, and side edge portions 27*a* intersecting flanges 24*a*, at right angles. Due to the foregoing construction, either side edge of a panel 13 can mate with an adjacent, parallel side edge of another such panel 13, when a pair of adjacent panels are laterally inclined toward one another. Such an arrangement is shown in FIG. 3. It should be noted that where the panel 13 desired is of a width greater that that which might be conveniently folded from available sheet metal coil stock, such panel 13 could be assembled from lengthwise sections of panel 13, such as three sections joined along broken lines 33 and 34 in FIG. 2. It will be noted in such case that the flanges are still arranged on lines which define the folded, transversely triangular elements, although such panel sections (which may themselves also be referred to as panels) themselves would only contain truncated sections.

In FIG. 3, a number of panels 13*a*, 13*b*, 13*c*, 13*d*, 13*e* and 13*f* are connected together, each of the foregoing panels being of the same construction as panel 13 of FIG. 2. Panels 13*b* and 13*c*, are disposed with their lower faces 15 facing upward as viewed in FIG. 3. Adjacent side edges of panels 13*a* and 13*b* are then overlapping somewhat, and are connected together in the manner shown. Due to the insloping side edge portions 27, 27*a* of the transversely triangular sections as previously described, when panels 13*a*, 13*b* and 13*c* are connected together in such an arrangement as in FIG. 3, the structure surface shown curves convexly upward as one moves laterally across panels 13*a* to 13*c*, as viewed in FIG. 3. Such a curvature can be continued if desired. Alternatively, the next panel 13*d* can be inverted with respect to panels 13*a* through 13*c*, that is disposed with its upper face 14 facing upward as viewed in FIG. 3, and again adjacent side edges of panels 13*c* and 13*d* can be overlapped and connected together due to the symmetry of the side edges of the panels. With panel 13*d* inverted, a reversing of the direction of curvature of the structure takes place, which is further carried on by panels 13*e* and 13*f* also disposed with their upper faces 14 facing upward as viewed in FIG. 3. Thus, as one moves laterally across the panels, from panel 13*c* to panel 13*f*, the curvature of the structure surface is concave upward as viewed in FIG. 3.

It should be noted that panels 13*a* and 13*b* are laterally inclined to one another, as are panels 13*b* and 13*c*, and panels 13*d*, 13*e* and 13*f*, the inclination being judged with reference to the fact that the planes in which flanges 20, 22 of the foregoing sets of panels lie are inclined toward one another. However, in the case of panels 13*c* and 13*d*, such planes are parallel, and therefore those panels can be considered not to be inclined to one another.

It will be appreciated that the degree of curvature can be controlled by decreasing the height of the folded triangular sections, namely decreasing the vertical distance as viewed in FIG. 2, between the uppermost ends of flanges 24, 24*a* and adjacent flanges 20, 22. Lowering such distance (i.e. lowering the angles which the faces 26, 26*a* make to a plane in which flanges 20, 22 lie to make the panel more flat), will decrease the angle of curvature which can be obtained by joining two such panels along their adjacent edges. However, by lowering such height the load which such panels can bear in the lateral direction, also tends to decrease. Thus, in cases where it is desired to have a lower angle of deflection, but the angle which faces 26, 26*a* make to the plane as described, is to be maintained constant in order to maintain structural strength of the panel, then the panel can be folded from sheet material with parallel side edges such that each folded triangular section has a plurality of interior flanges. Such an arrangement is shown in the panels of FIGS. 5, 5*b*, 8, and 8*b*.

The structure surface shown in FIG. 3, or similar structure surfaces, can be reinforced in a manner as shown in FIG. 3*a*. FIG. 3*a*, shows the six panels of FIG. 3, 13*a* through 13*f*. In addition, six elongated panels 35*a*, 35*b*, 35*c*, 35*d*, 35*e* and 35*f*, which have lengthwise extending parallel, flanges 36 and 38, are connected to respective surfaces of panels 13*a* through 13*f*, by means of welding, bolting or the like. Thus, the resulting structure will be less susceptible to collapse as a result of lengthwise folding of panels 13*e* through 13*h* lengthwise, than if such reinforcing panels 35*c* through 35*h*, had not been present.

The panel 42 of FIG. 5 is similar in construction to panel 13 of FIG. 2, and analogous elements have been numbered identically. Panel 32 is formed by folding flanges on an elongated sheet material, with parallel side edges, in a similar manner as panel 13 is formed. Panel 42, like panel 13, has sets of flanges 20, 22 defining transversely triangular elements therebetween, with adjacent such elements extending in alternate directions, as shown in FIG. 5. Each triangular element of the panel 42 though, is provided with flanges 44, 46, 48, or 44*a*, 46*a*, 48*a*. Adjacent numbers of panels can be connected together along their edges in a similar manner as panels 13, already described. When the upper surfaces 14 of a plurality of panels 42 face in the same direction, then the structure surface will be concave moving laterally across such adjacent panels. In a similar manner as with panels 13, some panels 42 can be inverted with respect to others so as to produce a structure surface which is convex in the same direction. FIG. 5*b* shows two panels 42*a* and 42*b* connected together along their adjacent edges and with their upper surfaces 14 facing in the same direction. Each panel 42*a*, 42*b* is of the same construction as panel 42 in FIG. 5. The result of the arrangement in FIG. 5*b* is a structure surface which is upwardly concave as one moves laterally across the two panels shown.

Referring to FIG. 8, the panel shown therein, is similar in construction to the panel of FIG. 2, and analogous parts have again been numbered identically. However, in FIG. 8, the panel 60 therein, is viewed toward the lower face 15 thereof. In addition, the panel 60 is folded so that the transversely triangular sections bounded by each pair of adjacent flanges 20, 22, and directed toward the first side edge 16, each contains a plurality of interior flanges, namely two flanges 62, two flanges 63, and one flange 18, and triangular faces 64, 66 and 70. The triangular sections directed or extending in the opposite direction (i.e. toward second side edge 18) are congruent with the foregoing triangular sections, with the former having flanges 62*a*, 63*a* and 68*a* and triangular faces 64*a*, 66*a*, and 70*a*. It will be noted from FIG. 8*a* that flanges 68 and 74, 63 and 22, and 63 and 20, are not coplanar, although they could be.

When two panels 60 are joined together along adjacent edges with both of their lower surfaces 15 being oriented upward, the result would be a structure surface which is convex in the lower surface direction. Alternatively, by simply inverting one or more of such panels 60, the direction of curvature as one moves laterally across such connected panels, can be altered. However, the panels used in such arrangement, should have flanges 68 and 74 coplanar, and flanges 63, 20, 22 coplanar, unlike the flanges of panel 60 of FIGS. 8 and 8*b*, in order to avoid gaps when joined as described. A junction of two such congruent panels 61*a* and 61*b*, each basically the same as panel 60 of FIG. 8, is shown in FIG. 8*b*. However, panels 61*a* and 61*b*, have coplanar flanges 68 and 74 and coplanar flanges 63, 20 and 22. Again, one panel 61*a* has its lower surface 15 facing in an opposite direction than the upper surface 14 of panel 61*b*, (i.e. the panels 61*a* and 61*b* are inverted with respect to one another). Such an arrangement by itself produces a structure surface which is essentially planar, which essentially planar arrangement could be continued by repeatedly inverting the direction in which the respective faces of a plurality of such adjacent panels face. It might be noted that in joining adjacent panels of a type of panel 61*a* or 61*b*, with corresponding faces facing in the same direction, the edges of such panels must be offset in a lengthwise direction of the panels, by 2 flanges, (i.e. one "cycle"), in order to obtain reasonably good mating of the respective side edges of the panels.

Referring now to FIG. 6, a panel structure is shown, which utilizes a panel 50, which may be conveniently referred to as first panel 50, along with two reinforcing panels 58. Panel 50 is also formed by folding an elongated sheet, such as sheet metal, which has parallel side edges. Panel 50 has two opposed side edges 51, and a first set of coplanar, parallel flanges 52, each of parallelogram configuration, and extending between side edges 51 at an angle of approximately 45 degrees. A second set of coplanar, parallel flanges 54 are further provided which are parallel and congruent with flanges 52, and which are disposed in alternating relationship therewith, in a plane parallel to that in which the first set of flanges 52 lie. Faces 56, also of parallelogram configuration, extend between each pair of adjacent flanges 52, 54. It will be noted that alternate faces 56 are oriented 180 degrees with respect to one another, but are nevertheless congruent. Reinforcing panels 58, 59 extend parallel with first panel 50, and have respective faces contacting and connected to respective adjacent faces of first panel 50, by means of welding or the like. Thus, reinforcing panel 58 will actually contact and be connected to flanges 52, while reinforcing panel 59 will actually contact and be connected to flanges 54. Reinforcing panels 58, 59 serve to carry at least partially, longitudinal compression forces on the panel structure 50. Such forces might otherwise tend to cause panel 50 to fold up or buckle along flanges 52, 54. In addition, the spaces between flanges 54 and panel 58, and flanges 52 and panel 59, can additionally act as insulating dead air spaces in a structure surface. Furthermore, if desired, such spaces can be filled with a suitable insulating material to increase the insulating value of the panel structure of FIG. 6.

Referring to FIG. 7, a panel structure is shown which utilizes two panels 50*a*, 50*b*, each of the same construction as panel 50, disposed parallel to one another and inverted relationship, with adjacent connected faces. In particular, flanges 54 of panel 50*a* are connected by means of welding or the like, to flanges 52 of panel 50*b*. Thus, the two panels 50*a*, 50*b* are oriented such that the flanges on panel 50*a* extend across the panel structure of FIG. 7, in a direction opposite to that of the flanges of panel 50*b*, in particular at 90 degrees with respect thereto. This arrangement also provides spaces between panels 50*a* and 50*b* which can act as insulating spaces in a similar manner as described in connection with the panel structure of FIG. 6. In addition though, this panel structure will also resist longitudinal compression forces far better than if panels 50*a* and 50*b* were oriented so that their flanges were all parallel. Furthermore, construction of such a panel structure is convenient, and relatively efficient, since the same panels need only be manufactured, with some panels being inverted with respect to other such panels and then connected thereto. It will be appreciated that the flanges of panels 50*a* and 50*b* could extend at an angle other than 45 degrees to the side edges of the respective panels. However, 45 degrees is preferred so that a given panel obtains maximum resistance to both lateral and longitudinal compression forces.

Referring now to FIGS. 9*a* and 9*b*, a panel 81 is shown, which has arcuate, generally parallel, first and second side edges, 82 and 84 respectively. Panel 81 again has sets of flanges 20 and sets of flanges 22 which are arranged on lines which define congruent folded, transversely triangular elements, extending laterally across the panel. That is, the lines upon which flanges 20, 22 lie, intersect to define such complete triangular sections, although panel 81 itself contains only truncated elements. In the case of panel 81 though, these elements are all radially aligned (i.e. directed toward a common center of a circle defined by panel 81). Panel 81 further has flanges 90, 92, and faces 94, 96 extending between adjacent flanges. The first side edge 82 has a greater radius of curvature than second side edge 84. Flanges 90, 92 have respective second linear portions 91, 93, which extend downward at an angle to the remainder of the respective flanges, such that a second side edge portion 90*b* of the element containing each flange 90, is lower than the opposite first side edge portion 90*a*, while a first side edge portion 92*a* of each flange 92 is lower than the opposite second side edge portion 92*b*. Thus, first side edge portions 92*a* of a first set of alternate truncated elements are lower than respective opposite second side edge portions 92*b*, while second side edge portions 90*b* of a second set of alternate truncated elements, are lower than respective opposite first side edge portions 90*a*. Furthermore, although linear portions 91, 93 extend downward at approximately the same angle, portions 91 are longer than portions 93. This means that second side edge portions 90*b* of the truncated elements of the second set (those containing flanges 90), are lower than first side edge portions 92*a* of the truncated elements of the first set (those containing flanges 92).

Panels 81 can be produced from an elongated sheet with parallel side edges, such as sheet metal coil stock. FIG. 9 indicates how such an elongated sheet is formed into a panel 81. This is accomplished by cutting out darts 86, 88, from the sheet as illustrated, the darts 86, 88, being of equal angle, but darts 88 being greater in length (thereby having a wider base or greater maximum width). Alternatively, the foregoing darts could be folded on the sheet. The sheet is then folded into the shape of the final panel 81, with flange portions 90 and 91 being bent downward to contact edge portions 95 and 97 respectively, and welded thereto. Since the darts 88 cut out of the panel have a wider base than darts 86, second side edge 84 will have a lower radius of curvature than first side edge 82. It should be noted at this point, that darts 86 and 86 in the blank shown in FIG. 9, are preferably equiangular to produce a better mating between adjacent side edges of the panels in the foregoing type of structure surface. Panel 81 is particularly useful for constructing dome type structures in a manner similar to that described below in connection with panels 94, one of which is shown in FIG. 10.

Referring now to FIG. 10, another panel 94 is shown, with a first side edge 96 and a second side edge 98. Panel 94 is similar in construction to panel 81, except that the "flanges" of panel 94 are single folds (i.e. appear as lines in the Figures). Again, sets of flanges 20, 22 are provided, which lie on lines which again converge to define folded, radially aligned, transversely triangular elements which are all "directed toward" second side edge 98 (that is flanges 20, 22 defining the truncated elements converge in the direction of second side edge 98). As in the case of panel 81 of FIG. 9*b*, panel 94 actually has only truncated elements on it. Both side edges 96, 98 are curved, with first side edge 96 having a greater radius of curvature. Alternate, transversely triangular elements include respective flanges 100, 106. Each flange 100 has a first linear portion 102, and a second linear portion 104 extending downward at an angle to portion 102 (i.e. toward flanges 20, 22) such that a second side edge portion 105 of the element containing each flange 100, is lower than the opposite first side edge portion 101 of the same element. Thus, it can be said that first side edge portions 107 of a first set of alternate truncated elements containing flanges 106, are lower than respective opposite second side edge portions 109. Likewise, second side edge portions 105 of a second set of truncated elements containing flanges 100, are lower in height than respective opposite first side edge portions 101. Furthermore, the second side edge portions 105 of the truncated elements of the second set (i.e. those elements containing flanges 102), are lower than the first side edge portions 107 of the elements directed toward them (i.e. those elements containing flanges 106).

Panel 94 can be formed in a manner similar to panel 81 of FIG. 9*b*, that is by cutting appropriate equiangular darts on alternate side edges of an elongated sheet having parallel side edges, at positions thereon at which flange portions 104 and 108 will be formed. The darts at which portions 104 are formed, will of course be longer than those at which portions 108 are formed. The sheet is then folded to form flanges 20, 22, 100, 106, with portions 104, 108 being formed by welding edge portions of corresponding faces where the darts have been cut. Thus, panel 94 is basically formed in the same manner as panel 81 except that the parallelogram shaped flange portions of panel 81 are replaced by flange portions which appear as lines.

FIG. 1O*a* illustrates construction of a dome utilizing a plurality of panels 94*a*, 94*b*, 94*c*, each constructed in the manner of panel 94 in FIG. 10. In each case, second side edge 98 of each of a plurality of panels 94*a*, 94*b* (only a portion of the length of each of such panels being shown in FIG. 1O*a* so as to reveal the underlying structure), is mated with, and connected to, a first side edge 96 of respective adjacent panels 94*b*, 94*c*. Thus, panel 94*b* is inclined downward as viewed in FIG. 1O*a*, with respect to panel 94*a*. Likewise, panel 94*c* is inclined downward with respect to panel 94*b*. Of course, it will be appreciated that as one moves up the dome-shaped structure surface shown in FIG. 1O*a*, panels must be utilized which have a first side edge 96 with a radius of curvature and other dimensions approximately the same as the second side edge 98 of the next lower panel. However, as the dome will usually be relatively large in diameter, this allows a large number of identical panels to be produced for each annular layer of panels 94*a*, 94*b*, 94*c*, and other such layers.

In the structure of FIG. 1O*a*, reinforcing panels 112 are also provided, which again can be manufactured from sheet metal coil stock, but with flanges which extend in a direction lengthwise thereon. Panels 112 have surfaces which are connected to adjacent surfaces of panels 94*a*, 94*b*, 94*c*. Such an arrangement reinforces the structure surface against compression forces which might otherwise tend to compress panels 94*a*, 94*b*, 94*c*, if reinforcing panels 112 were not provided.

Figure 1:
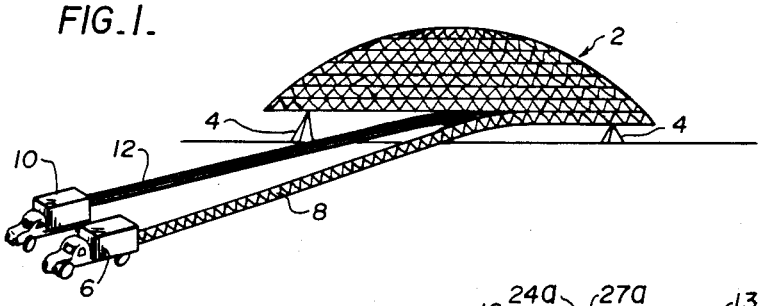
FIG. 1 is a perspective, schematicized view of a structurel surface being constructed in accordance with a method of the present invention.

In constructing a dome structure such as that in FIG. 1O*a*, it is possible to utilize a method such as that schematically illustrated in FIG. 1. In FIG. 1, the dome structure surface is labelled 2. Such structure surface 2 is mounted upon supports 4, which are capable of raising the structure up as desired. Two trucks 6, 10 can be provided which contain supplies of sheet metal coil stock, as well as equipment for folding the same. Such equipment feeds out elongated panels 8 with laterally extending flanges thereupon, and elongated panels 12 with flanges extending in a direction lengthwise thereupon. Panels 8 can be arranged to overlie, and be connected to adjacent corresponding panels 12. As each annular layer is added on, an upper side edge of the newly added, lower panel or panel structure, is connected by suitable means such as welding, bolting, or the like, to a mating side edge of an upper adjacent panel. The structure is then raised, and the foregoing process repeated for a new annular layer.

It will be appreciated that the basic panel structures described can be reinforced by having various patterns impressed upon their surfaces. One such arrangement is shown in a panel 40 of FIG. 4. Panel 40 is similar in construction to panel 13, and again analogous parts have been numbered identically. However, in panel 40, flanges 20 and 22 have a parallelogram configuration, while flange 24 has a triangular configuration. As well edge portions 23 at the intersection of flanges 20, 22 will have a slight upward turn as a result of the folding operation. However, such will not interfere with the connection of like panels, and in fact assist such connection. With this configuration, it should be noted that the maximum width of flanges 24 must be approximately equal to the sum of the widths of flanges 20, in order to ensure a reasonably good mating of adjacent edges of 2 panels with side surfaces facing in opposite directions. In addition, the maximum strength of such a panel 40 is obtained when the width of flanges 24 one half way along their length, is approximately equal to the width of each flange 20, 22.

A portion of another possible panel 110, again basically similar to that of panel 13, is shown in FIG. 11 with flanges 20, 22 again being shaped in the form of parallelograms, and flange 24 being connected thereto by surfaces shaped as shown. It will be noted that panel 110 is basically the same in construction as panel 40 of FIG. 4, with further patterns impressed upon its surface. It should be noted that raised portions 112 of panel 110 are particularly important in maintaining the side edges of panel 110 rigid, so that when two such panels are interconnected, less points of attachment will be required to maintain a good connection than if equivalent sized panels 40 were used.

Further panel structures can be formed by connecting faces of reinforcing panels, such as panels 58,59 to faces of panels such as lower face 15 of panel 13 in FIG. 1. Furthermore, reinforcing panels could if desired, be connected to both sides of any of the panels described, for added strength. As well, many of the panels described, could be assembled from appropriately folded lengthwise sections of panels in a manner similar to that as described already in connection with panels 13. Again, such is particularly useful where the width of the desired panel is greater than that which can be conveniently folded from available sheet metal coil stock.

As will be apparent to those skilled in the art in light of the foregoing disclosure, many alterations and modifications are possible in the practice of this invention without departing from the spirit or scope thereof. Accordingly, the scope of the invention is to be construed in accordance with the substance defined by the following claims.

I claim:

1. An integral, elongated panel strip comprising generally parallel sides and transversely folded converging corrugations alternately extending across the panel in opposite directions, each corrugation having at least three sloping triangular faces which converge at their apexes, said corrugations having in-sloping side edges, each side edge of a panel strip being identically shaped such that either side edge can mate congruently with either side edges of a corresponding panel strip.

2. A panel strip as defined in claim 1 further comprising a reinforcing panel strip having a plurality of longitudinally folded parallel corrugations, each having two rectangular faces wherein a surface of said first panel strip is connected to a respective surface of the reinforcing panel strip.

3. A panel strip as defined in claim 2 wherein said rectangular faces are separated by a planar element.

4. A method of construction a structure surface comprising the steps of:

(a) supplying continuous sheet metal from a coil stock having parallel side edges;

(b) transversely folding said sheet metal to produce a panel strip having identically shaped side edges defining converging corrugations extending across the panel in alternating directions, each corrugation having at least three sloping triangular faces which converge at the apexes;

(c) positioning the panel strips with mating side edges parallel and adjacent one another; and (d) joining adjacent mating side edges of the panels.

5. A method as defined in claim 4 wherein an adjacent panel strip is inverted before being joined to a first panel strip.

6. A method as defined in claim 4 further comprising the steps of forming a plurality of reinforcing panel strips from sheet metal coil stock by longitudinally folding said sheet to form a plurality of parallel corrugations having rectangular faces;

positioning said reinforcing panel strips parallel with said first panel strips with surfaces of said first panel strip adjacent to a respective surface of the reinforcing panel strip; and connecting such adjacent surfaces.

* * * * *